United States Patent [19]

Gandini

[11] Patent Number: 4,979,245

[45] Date of Patent: Dec. 25, 1990

[54] SELF-CLEANING WHIRLPOOL SYSTEM FOR BATHTUBS IN GENERAL

[75] Inventor: Luigi Gandini, Cernusco Lombardone, Italy

[73] Assignee: American Standard Inc., New York, N.Y.

[21] Appl. No.: 339,751

[22] Filed: Apr. 18, 1989

[30] Foreign Application Priority Data

Apr. 20, 1988 [IT] Italy ..... 46837 A/88

[51] Int. Cl.[5] ..... A61H 33/02; B08B 9/04

[52] U.S. Cl. ..... 4/542; 4/662; 134/169 C

[58] Field of Search ..... 4/541, 542, 543, 544, 4/538, DIG. 10, 662; 134/169 R, 169 C

[56] References Cited

U.S. PATENT DOCUMENTS

| | | | |
|---|---|---|---|
| 4,237,562 | 12/1980 | DuPont | 4/543 |
| 4,383,341 | 5/1983 | Altman | 4/538 |
| 4,419,775 | 12/1983 | Ebert | 4/541 |
| 4,530,120 | 7/1985 | Etani | 4/538 |
| 4,552,658 | 11/1983 | Adcock | 4/542 |
| 4,563,781 | 1/1986 | James | 4/542 |
| 4,780,917 | 11/1988 | Hancock | 4/542 |
| 4,857,112 | 8/1989 | Fränninge | 4/507 |

FOREIGN PATENT DOCUMENTS

| | | | |
|---|---|---|---|
| 41378 | 3/1980 | Japan | 4/542 |

*Primary Examiner*—Ernest G. Cusick
*Assistant Examiner*—Keith Kupferschmid
*Attorney, Agent, or Firm*—Blum Kaplan

[57] ABSTRACT

A self-cleaning whirlpool system for spas, including bathtubs, is disclosed. The system comprises a circulating pump connected to a water intake pipe, a filter and a hydraulic circuit having nozzles for whirlpool massage. An air intake circuit is provided for mixing air into the water delivered to the nozzles. Valve means are provided to close the nozzles to form a closed circuit. Cleansing agent is metered into the closed circuit, together with water, and is circulated through the closed circuit by means of the circulating pump. After the closed circuit is cleansed, the dirty water and cleaning agent are drained off.

8 Claims, 3 Drawing Sheets

SELF-CLEANING WHIRLPOOL SYSTEM FOR BATHTUBS IN GENERAL

BACKGROUND OF THE DISCLOSURE

1. FIELD OF THE INVENTION

The invention is directed to a whirlpool system for bathtubs, spas or the like thai is capable of autonomously washing and disinfecting all the pipes which are used during the whirlpool massage phase.

2. DESCRIPTION OF PRIOR ART

It is known that the installation, in bathrooms in general, of bathtubs equipped with whirlpool systems is becoming more and more common. It is also known that such bathtubs can be used in the normal manner when one is taking a bath while, during the whirlpool massage phase, a portion of the water present in the tub is constantly being withdrawn by a suitable circulation pump, and then reintroduced back into the tub through a series of nozzles located below the water level.

In addition, this water recirculation circuit is accompanied by pipes by means of which a certain quantity of air is mixed with the water directed into the tub, with the possibility of regulation.

Since the water used for a whirlpool system becomes mixed with a variety of substances, such as oils, soap, powder, skin particles and body grease, after a certain period of use disadvantageous deposits form and continue to build up in the pipes of the whirlpool system, and in the passthrough sections of the pump. Moreover, as time passes, these deposits begin to emit unpleasant odors and some of them become detached and circulate with the whirlpool water, presenting obvious problems of cleanliness and hygiene.

Since the whirlpool system is not only enclosed but also heremetically sealed, procedure for keeping it clean is as follows: the bathtub is filled with water in which a suitable detergent has been diluted, then the whirlpool system is operated for a relatively long period, and the water is drained off. After this procedure, the tub, which will inevitably be dirty, must be cleaned. Before doing this, it is necessary to operate the sytem with clean water to remove the detergent that has remained in the pipes. It is obvious that such a procedure requires the use of excessive waste of both water and electrical energy, it takes a particularly long time, and requires the constant presence of a person who must perform a number of operations.

SUMMARY OF THE INVENTION

The principal object of this invention is to make available, a self-cleaning whirlpool system which is capable of overcoming the above disadvantages by employing a simple and rational design solution.

The invention generally contemplates providing the proposed system of the type described initially and, also, providing each individual whirlpool nozzle, the water filter connected to the system's pump, and air mixing valves for mixing air into the whirlpool water with valve means which are open during the whirlpool massage phases and closed when the system is being cleaned. A bypass pipe including an associated valve, operably couples the hydraulic circuit and the air circuit to the intake pipe of the circulation pump.

With the aforesaid means, the whirlpool system can be isolated from the basin or sump of the corresponding bathtub and connected to a suitable source of water under pressure, such as the normal water mains, then filled with water and mixed with a detergent product. The latter is introduced by a pumping unit separate from the circulation pump, which then causes the water to run through the entire system around a closed circuit. At the end of this phase, i.e. cleaning or washing phase, the water mixed with detergent is drained directly into the drain or outlet siphon of the bathtub, together with the dirt removed from the system. After the washing phase, a rinse phase is used to remove detergent residues from the system. Thereafter, the system is reconnected to the basin or sump of the bathtub. The sequence of all the aforesaid operations is controlled by a suitable apparatus, such as a card-programmed electronic device, not shown.

From the foregoing, the objects of the invention are achieved, specifically, the quantity of water required for cleaning is much less than that required according to the prior art, since it is not necessary to fill the bathtub.

Cleaning is also accomplished in a relatively brief period, with a resulting decrease in the consumption of electrical energy; moreover, the constant presence of a person is no longer necessary, since cleaning occurs automatically and while during the cleaning and rinse phase, the tub does not become dirty since the water is conveyed directly to the drain.

The design characteristics and merits of the invention, and the manner in which it functions, will be explained more clearly in the course of the detailed description which follows, given with reference to the attached FIGURES which illustrate one particular and preferred embodiment thereof.

DETAILED DESCRIPTION 0F THE PREFERRED EMBODIMENT

It is understood that the type, shape and dimensions of the whirlpool bath shown in the attached FIGURES is by way of illustration since the various elements of the invention are well suited to be used for whirlpool systems and baths in general.

Figure 2:
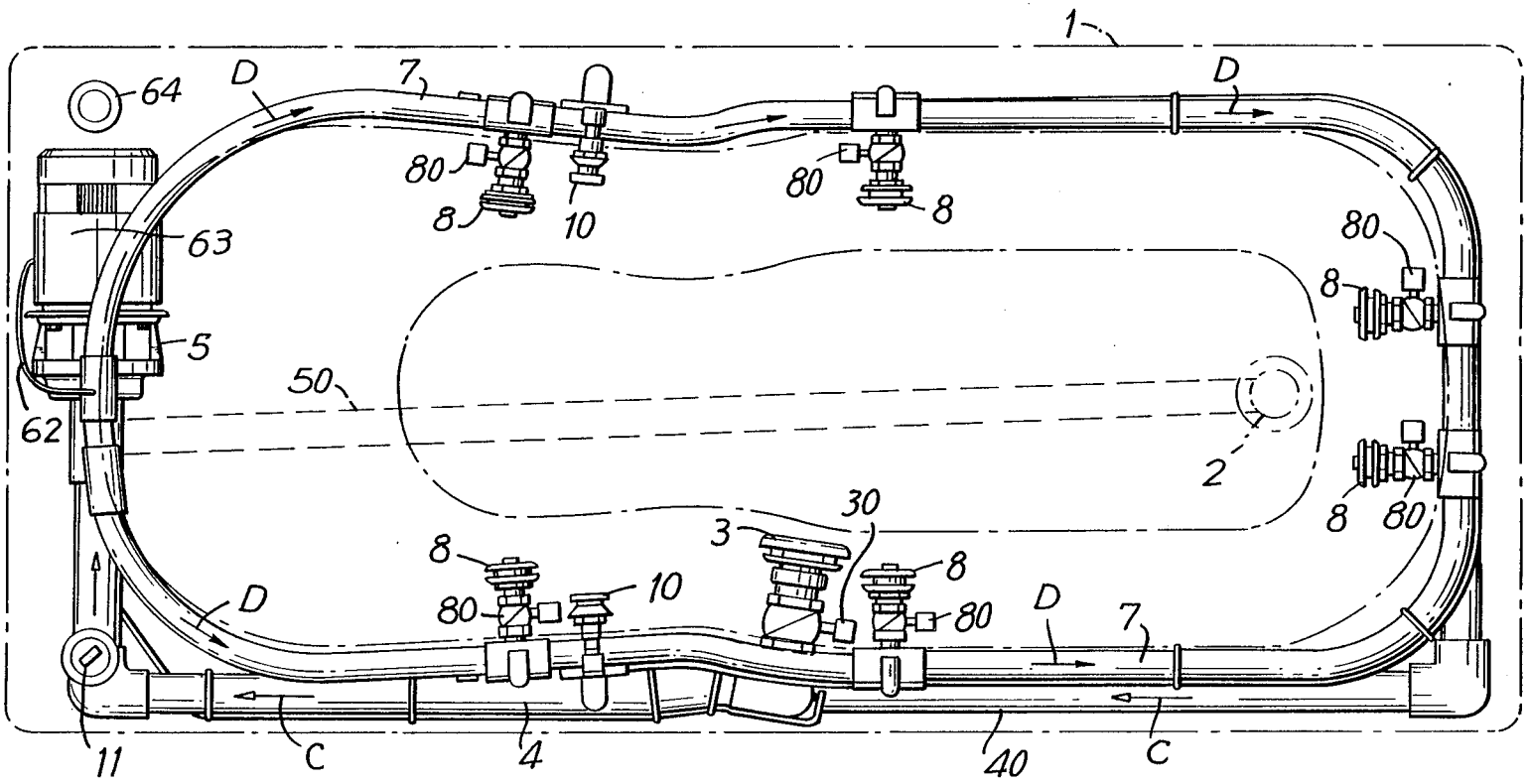
FIG. 2 is a top plan view thereof.

In the FIGURES, bathtub 1 is provided with drainage outlet 2, see FIG. 2. The fittings of bathtub 1 have not been shown since they can vary, and also because their utilization is known in the art.

Figure 1:
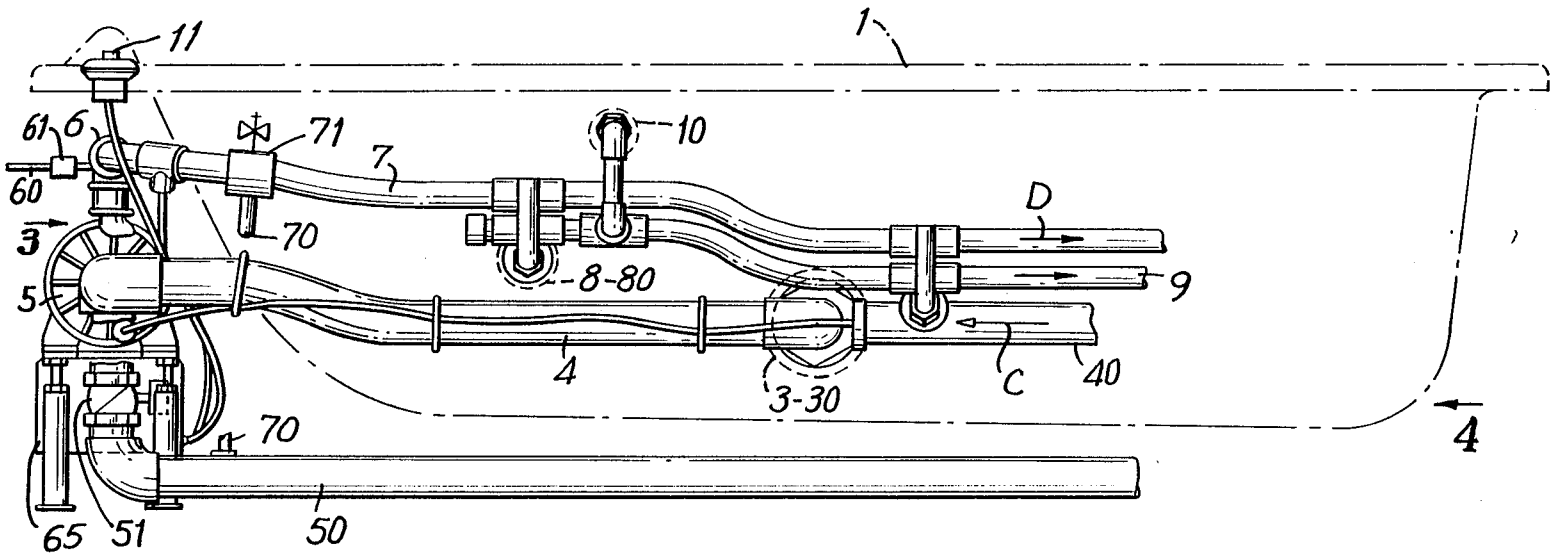
FIG. 1 is an elevational view of a whirlpool bath assembly, illustrating a preferred form of the invention.

As illustrated in the drawings, particularly FIGS. 1 and 2, bathtub 1 is fitted with a whirlpool system which comprises a water intake filter 3 located near its bottom, from which is coupled a water intake pipe 4 which is connected to an electric-powered circulation pump 5. Hydraulic circuit 7, a conduit, is mounted around bathtub 1, to which is connected a series of whirlpool nozzles 8 mounted, in a manner known in the art, to the lateral surface of bathtub 1. The ends of hydraulic circuit 7 are coupled to a T-shaped connection 6, shown clearly in FIG. 3. Usually, nozzles 8 can be oriented and adjusted, as desired.

Air circuit 9, a conduit, is connected to two air intake apertures or valves 10, as shown in FIG. 2, and is mounted below and adjacent to hydraulic circuit 7, and disposed around bathtub 1 in generally parallel relation to hydraulic circuit 7. Air apertures 10 are located close to the upper rim of bathtub 1, and their function is to take in ambient air, which is first delivered into conduit 9 and then mixed with the water delivered by nozzles 8. The connections between conduits 9 and nozzles 8 have not been shown since they are familiar and known to persons skilled in this art. Also, the volume of air conducted through air valves 10 is manually regulated and may be closed, if desired. The operation of the whirlpool system described up to this point is started by a pushbutton 11, preferably pneumatic, which is designed to control starting and stopping of pump 5.

A description of the operation of the whirlpool system will be omitted since it is well known and easily understandable from the above discussion.

The self-cleaning whirlpool system, according to the invention, includes a plurality of valves 80 mounted to hydraulic circuit 7, operatively coupled immediately upstream from the delivery orifice of each nozzle 8. Valves 80 are preferably of the pneumatic type. A similar valve 30, FIG. 2, is located immediately behind filter 3. At the upstream end of intake pipe 4, there is operatively mounted immediately behind valve 30, a bypass pipe 40 which extends towards the opposite end of bathtub 1, where it is connected to hydraulic circuit 7 and air circuit 9, respectively.

Figure 3:
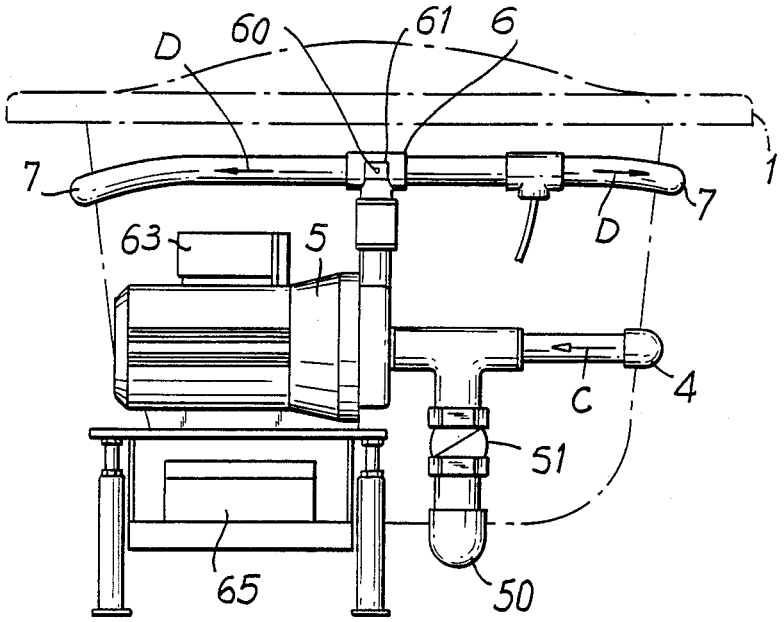
FIGS. 3 and 4 are opposite end views, in elevation, taken along the lines 3—3 and 4—4, respectively, of FIG. 1.
Figure 4:
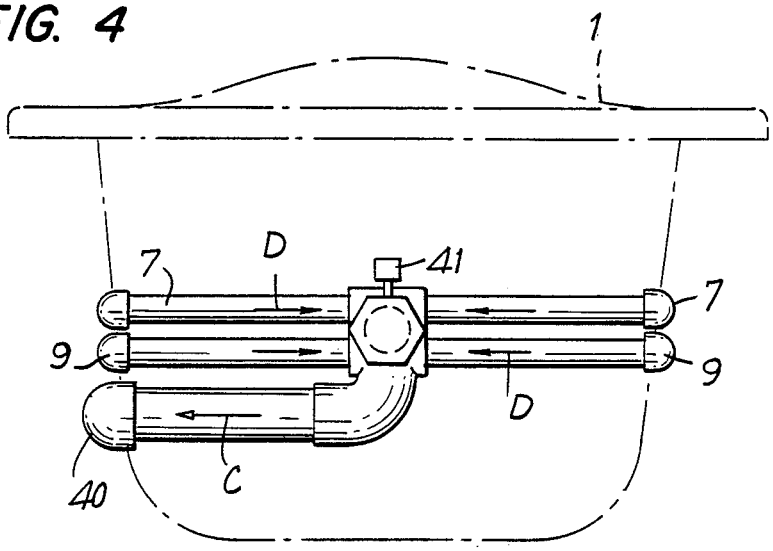

A pneumatic valve 41, FIG. 4, is interposed and is normally closed during the whirlpool massage phase. A drain pipe 50, FIGS. I and 3, is provided, and is interrupted by a solenoid valve 51. Drain pipe 50 connects the downstream end of water intake pipe 4 to the drain siphon located beneath outlet 2, FIGS. 1,2,3.

Connected to T-fitting 6 of pump 5, is a flexible tube 60 which is connected to the water mains, not shown, and is equipped with a solenoid valve 61. Also connected to T-fitting 6 is a small tube 62, FIG. 2, which branches off from a pumping unit 63 and which draws from a tank, not shown, a suitable detergent liquid contained therein.

A lighted pushbutton 64 actuates the washing cycle for self-cleaning the system, the operating sequences of which are controlled by apparatus 65, FIGS. 1 and 3, which includes an electronic card having a printed program thereon, not shown.

With reference to FIG 1, hydraulic circuit 7 is connected to drain pipe 50 through a breather tube 70, with which solenoid valve 71 is operatively mounted.

The automatic washing cycle for the whirlpool proceeds as follows: after air valves 10 have been closed by hand, the user presses pushbutton 64, which causes valves 30 and 80 to close so that the system is separated from the basin or sump of bathtub 1. Then valves 61,71,41 automatically open so that the system is connected through valve 61 to the water mains, not shown, while the air present in the system drains into the siphon through valve 71.

After a predetermined delay following the preceding operation, pump unit 63 operates so as to introduce a metered quantity of detergent into hydraulic circuit 7. A suitable pressure sensor, not shown since it is known in the art, senses that the system has filled with water and sends a signal to apparatus 65 which, in turn, causes valves 61 and 71 to close and shuts off pump unit 63. At this point, pump 5 operates for a period varying between 5 and 10 minutes, depending on the size of the system. The water mixed with detergent follows a closed circuit defined by conduits 40 and 4, pump 5, hydraulic circuit 7 and air circuit 9. Letter references C and D indicate the directions of the two water streams during intake and delivery, respectively.

When washing or cleaning is complete, pump 5 stops, valve 51 is caused to open, and all of the detergent/water mixture runs into the drain. Valve 51 then closes and the rinse phase or cycle begins. The rinse phase is designed to remove detergent residues and dirt from the system. For this rinse phase, valves 41,61,71 open in order to fill the system with clean water and drain air into the siphon, detergent pump unit 63 switches off, pump 5 operates for 2 to 5 minutes after valves 61 and 71 have closed, and valve 51 opens to drain off the rinse water.

After the system is drained, valves 51 and 41 close, and valves 30 and 80 open so that bathtub 1 is again ready for a new whirlpool massage cycle, or for a normal bath. For the former mode, the user must simply open air valves 10 and adjust them, as desired.

It should be understood that this invention is not limited solely to the embodiment shown and described but, rather, variations and modifications may be made without detracting from the invention herein. For example, air intake valves 10 may be coupled to valves mounted behind them. Such valves are preferably of the pneumatic type, which are capable of closing simultaneously with closure of valves 80 and 30, when the system begins an automatic washing/cleaning cycle. Also, valves 51,61,71 may be of the pneumatic type.

It is claimed:

1. A self-cleaning system for use in conjunction with a whirlpool having a sump portion defined by walls having inner and outer surfaces, a drain conduit, and supply means for supplying water under pressure from a water main to the whirlpool, comprising:

an air intake circuit assembly and a hydraulic circuit assembly supported on the outer surface of said walls defining said sump portion;

a circulating pump operably coupled to said air intake and hydraulic circuit assemblies;

said hydraulic circuit assembly having a plurality of water jet discharge nozzles mounted in spaced-apart relation around said sump portion of said whirlpool;

said air intake circuit assembly having at least one air intake opening mounted to said whirlpool, said air intake circuit assembly having means to mix air into said hydraulic circuit assembly conducted through said water jet discharge nozzles;

first valve means coupled intermediate said supply means and said air intake and hydraulic circuit assemblies and displaceable between a whirlpool mode where water from said supply means is not directly introduced into said air intake and hydraulic circuit assemblies and a cleaning mode where water from said supply means is directly supplied under pressure into said air intake and hydraulic circuit assemblies;

second valve means operably coupled to said air intake circuit and hydraulic circuit assemblies and being mounted in juxtaposition, respectively, to said at least one air intake opening and each of said plurality of water jet nozzles, said second valve means being displaceable between said whirlpool mode where said at least one air intake opening and water jet nozzles are open to said sump portion of said whirlpool and a cleaning mode where said at least one air intake opening and water jet nozzles are closed to said sump portion of said whirlpool;

metering means coupled to said whirlpool to provide a predetermined amount of a cleansing agent into said air intake and hydraulic circuit assemblies when said first and second valve means are positioned in their cleaning mode so that a mixture of cleansing agent from said metering means and fresh water from said supply means is circulated by said pump through said air intake and hydraulic circuit assemblies for a predetermined period of time;

third valve means operatively coupled to said air intake and hydraulic circuit and the drain conduit and displaceable between a first position where said drain conduit is closed to said air intake and hydraulic circuit assemblies and a second position where said drain conduit is open to said air intake and hydraulic circuit assemblies to discharge said cleansing agent water mixture from said air intake and hydraulic circuit assemblies into said drain conduit;

a control unit operatively coupled to said first, second and third valve means, said metering means and said circulating pump, said control unit being electrically operative to selectively shift said first and second valve means from their whirlpool mode to their cleaning mode, and said third valve means from its first to its second position; and switch means to actuate said control unit.

2. The self-cleaning system in accordance with claim 1, wherein said metering means includes a pump unit having intake and outlet openings and whose intake opening is adapted to be operably coupled to a tank containing a cleansing agent, and a conduit is connected between the outlet opening of said pump unit of said metering means and said hydraulic circuit assembly so that said cleansing agent is metered in a predetermined quantity when said whirlpool is in its cleaning mode.

3. The self-cleaning system in accordance with claim 1, wherein said circulating pump has an intake opening, further including a fourth valve which is mounted between the intake opening of said circulating pump and said drain conduit.

4. The self-cleaning system in accordance with claim 1, further including a breather tube mounted between said drain conduit and said hydraulic circuit, and a fifth valve coupled to said hydraulic circuit and to one end of said breather tube.

5. The self-cleaning system in accordance with claim 1, wherein said hydraulic circuit assembly includes a water filter and filter valve means, which are operatively coupled downstream of said circulating pump and upstream of said drain conduit when said system is in said cleaning mode.

6. The self-cleaning system in accordance with claim 1, wherein said control unit is operatively coupled to said at least one air intake opening and said plurality of said water jet discharge nozzles to shift said second valve means from its normal whirlpool mode to its cleaning mode.

7. The self-cleaning system in accordance with claim 1, where said second valve means includes a pneumatically operated valve for opening and closing said water jet nozzles and a manually operated valve for opening and closing said at least one air intake opening.

8. The self-cleaning system in accordance with claim 1, wherein said control unit includes program means to automatically shift said whirlpool from its normal whirlpool mode to its cleaning mode.

* * * * *